United States Patent [19]

Nozaki

[11] Patent Number: 4,493,626

[45] Date of Patent: Jan. 15, 1985

[54] AUXILIARY RADIALLY SHIFTING MECHANISM FOR VANES IN A PUMP OF THE VANE TYPE

[75] Inventor: Tadashi Nozaki, Hyogo, Japan

[73] Assignee: Mitsubishi Denki Kabushiki Kaisha, Tokyo, Japan

[21] Appl. No.: 400,717

[22] Filed: Jul. 22, 1982

[51] Int. Cl.[3] ..... F04C 2/00

[52] U.S. Cl. ..... 418/260

[58] Field of Search ..... 418/260-265

[56] References Cited

U.S. PATENT DOCUMENTS

| | | | |
|---|---|---|---|
| 284,125 | 8/1883 | Gibb | 418/260 |
| 1,023,872 | 4/1912 | Pearson | 418/260 |
| 1,121,628 | 12/1914 | Hoffmann | 418/260 |
| 3,955,540 | 5/1976 | Blanchard | 418/260 |
| 4,133,618 | 1/1979 | Smolinski | 418/263 |

FOREIGN PATENT DOCUMENTS

| | | |
|---|---|---|
| 51-9705 | 3/1976 | Japan . |
| 52-24806 | 6/1977 | Japan . |
| 53-114509 | 10/1978 | Japan . |
| 54-164906 | 11/1979 | Japan . |

*Primary Examiner*—John J. Vrablik
*Assistant Examiner*—Jane E. Obee
*Attorney, Agent, or Firm*—Wenderoth, Lind & Ponack

[57] ABSTRACT

An auxiliary radially shifting mechanism for vanes in a pump of the vane type having a cup-shaped cylinder, a rotor eccentrically and rotatably received within the cylinder, a number of vanes radially shiftably disposed within said rotor, and a bracket closing the cylinder at its open end, is provided in the form of a ring-shaped projection formed on the bracket so as to protrude therefrom towards the side of the vanes and to surround the rotor, the outer edge of the projection being rounded.

1 Claim, 4 Drawing Figures

AUXILIARY RADIALLY SHIFTING MECHANISM FOR VANES IN A PUMP OF THE VANE TYPE

CROSS-REFERENCE TO RELATED APPLICATION

This application is related to U.S. application Ser. No. 400,716, filed the same day as the present application by the same inventor.

BACKGROUND OF THE INVENTION

1. Field of the Invention

The present invention relates to a pump and more particularly to an improvement in an auxiliary radially shifting mechanism for vanes in a pump of the vane type.

2. Description of the Prior Art

Hitherto, the pumps of this type have generally had a constitution such as that illustrated in FIGS. 1, 2, and 3 of the drawings in which a rotor 5 fixedly secured to a driving shaft 1 is rotatably received within a cup-shaped cylinder 2 eccentric to the center of the cylinder 2, a number of vanes 7 being disposed within slots 5*a* (FIG. 2) formed in rotor 5 so as to be radially shiftable, and vanes 7 are adapted to have their radial outer ends abut against the inner periphery of cylinder 2 so that fluid is sucked through a suction port 8 provided in cylinder 2 to be discharged throgh a discharge port 9 also provided in cylinder 2. In the drawings, the reference numeral 3 is a bracket secured to cylinder 2 to sealingly close cylinder 2; 4 is a bearing to rotatably support driving shaft 1 in bracket 3; 6 is a fluid seal to prevent the fluid within cylinder 2 from leaking; and 3*a* is a ring-shaped projection provided on bracket 3 so as to be concentric with cylinder 2.

The operation of the pump described above is as follows.

As rotor 5 is rotated by means of driving shaft 1 by a prime mover (not shown), centrifugal force is applied to vanes 7 radially shiftably disposed within slots 5*a* formed in rotor 5 so that they are urged radially outwards in slots 5*a*, vanes 7 revolving relative to cylinder 2 with their radially outward end portions abutting against the inner periphery of cylinder 2. Due to the constitution as above described, as vanes 7 revolve, the fluid enclosed within fluid delivery chambers 2*a* and 2*b* each defined by the inner periphery of cylinder 2, rotor 5 and neighboring vanes 7 is discharged through discharge port 9, new fluid being again sucked through suction port 8, and thus the pump functions as a fluid pump to deliver the fluid under pressure. In this conventional pump, ring-shaped projection 3*a*, provided on bracket 3 concentric with cylinder 2, acts such that, when the centrifugal force applied to vanes 7 is low as a result of a low rotary speed of rotor 5, it forcefully thrusts vanes 7 radially outwards with respect to rotor 5 so as to cause the radially outward ends of vanes 7 to abut against the inner periphery of cylinder 2 so as to form fluid delivery chambers 2*a* and 2*b*.

From the foregoing it will be appreciated that a conventional pump of the vane type having the constitution and the operation described above exhibits such defects that, when the rotational speed of rotor 5 is low and if the viscosity of the fluid to be pumped is high, since ring-shaped projection 3*a* provided on bracket 3 must always urge vanes 7 radially outwards, the portion of vane 7 which comes into contact with projection 3*a* wears out to take a configuration with substantially the same curvature as that of projection 3*a* as the operation time of the pump increases, resulting in a decrease in the mechanical strength of the vanes 7 due to their shape in the worn out configuration and in particular due to their sharp corners.

SUMMARY OF THE INVENTION

It is an object of the present invention to provide an improved auxiliary radially shifting mechanism for vanes in a pump of the vane type which can avoid the defects in the conventional mechanism as described above.

It is another object of the present invention to provide an auxiliary radially shifting mechanism for vanes in a pump of the vane type which can prevent the vanes from being abnormally worn owing to the occurrence of a hunting phenomenon, i.e., oscillation of the vanes up and down in an effort to find an equilibrium position, thus causing imcomplete closure of fluid delivery chambers between the inner periphery of the cylinder of the pump and the outer periphery of the rotor.

In accordance with the present invention an auxiliary radially shifting mechanism for vanes in a pump of the vane type is provided wherein the ring-shaped projection provided on the bracket of the pump as the auxiliary radially shifting mechanism is so shaped that its outer peripheral edge is rounded.

BRIEF DESCRIPTION OF THE DRAWINGS

Other objects and advantages of the present invention will become apparent from the following description considered in conjunction with the accompanying drawings wherein there are set forth by way of illustration and example certain embodiments of the present invention, in which.

In the drawings similar or corresponding elements bear identical reference numerals throughout.

DESCRIPTION OF THE PREFERRED EMBODIMENT

Figure 1:
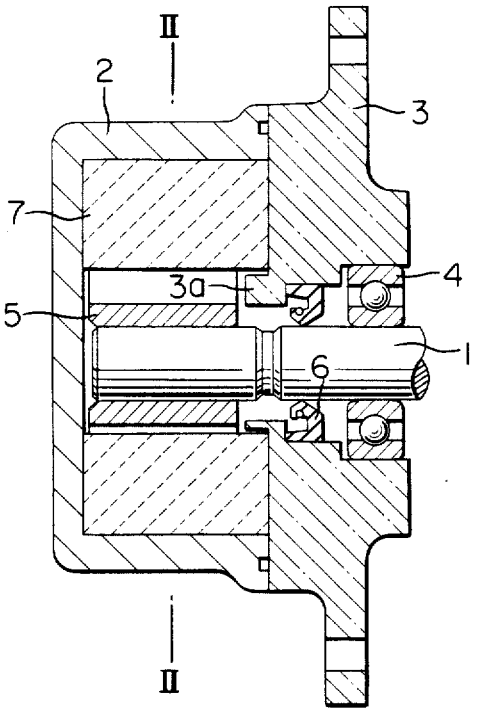
FIG. 1 PRIOR ART
FIG. 1 is a longitudinal sectional view of a conventional pump of the vane type.
Figure 2:
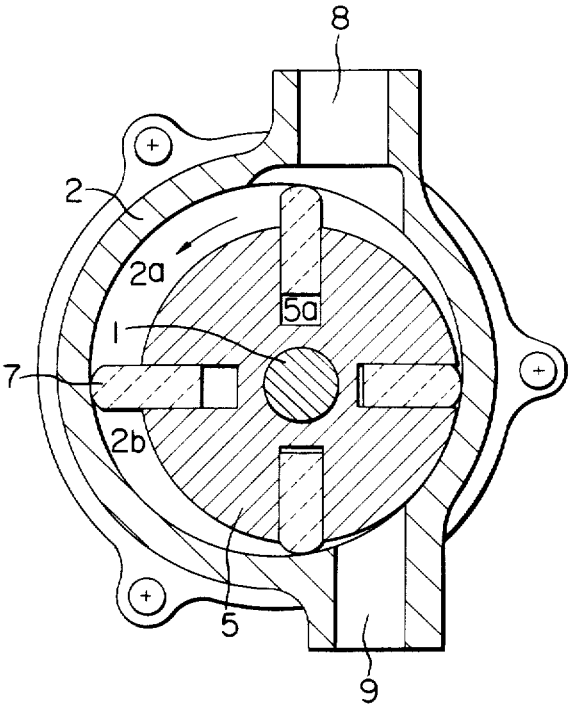
FIG. 2 PRIOR ART
FIG. 2 is a cross-sectional view of the pump shown in FIG. 1 taken along the line II—II of FIG. 1.
Figure 3:
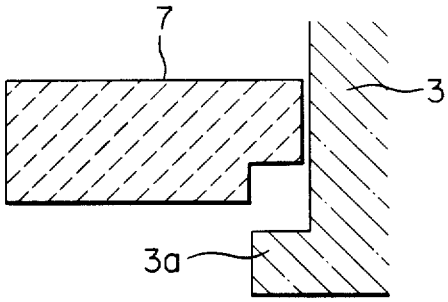
FIG. 3 PRIOR ART
FIG. 3 is a partial sectional view showing the shapes of the ring-shaped projection and a worn-out vane on a larger scale than FIGS. 1 and 2.
Figure 4:
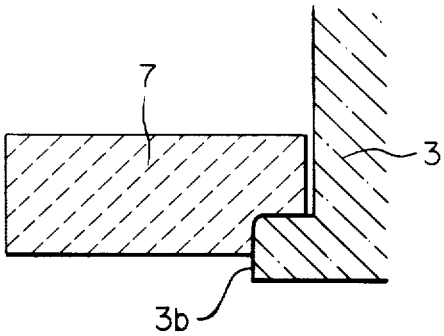
FIG. 4 is a partial sectional view showing the shapes of the ring-shaped projection according to the present invention and a worn-out vane also on a larger scale.

Referring now to FIG. 4 of the drawings wherein there is shown a portion of a ring-shaped projection 3*b* acting as the auxiliary radially shifting mechanism in accordance with the present invention on a larger scale, ring-shaped projection 3*b* being provided on bracket 3 in a manner similar to that of 3*a* shown in FIG. 1 so far as the location is concerned. However, as is apparent from comparison of FIG. 4 with FIG. 3 wherein there is shown a portion of FIG. 1 on a larger scale and on the assumption that vane 7 has been worn out due to its repetitive contacts with ring-shaped projection 3*a*, the outer edge of ring-shaped projection 3*b* according to the present invention is rounded, whereas that of 3*a* is sharp.

As the result of this difference in shape of the outer edge of the ring-shaped projections 3*a* and 3*b*, after the repeated contact of vane 7 with ring-shaped projection 3*a* or 3*b*, although conventional projection 3*a* causes vane 7 to be worn out to have a configuration with the same curvature as projections 3*a*, itself as shown in FIG. 3, i.e. a configuration with a sharp corner, projection 3*b* in accordance with the present invention causes vane 7 to be worn out to have a configuration with the same curvature as projection 3*b*, as shown in FIG. 4, i.e. a configuration having a rounded corner.

Of course, it is needless to say that the rounded corner of the worn out configuration of the vane 7 is greatly superior in terms of mechanical strength of the vane 7 to the sharp corner as in the conventional ring-shaped projection 3*a*. Therefore, it will be appreciated that the present invention can provide vanes 7 for a pump of the vane type which do not decrease in mechanical strength even if the pump is operated for a long time.

It is to be understood that although only certain forms of the present invention have been illustrated and described, it is not to be limited thereto except sofar as such limitations are included in the following claims.

What is claimed is:

1. In a pump of the vane type having a cup-shaped cylinder with a suction port and a discharge port, a rotor eccentrically and rotatably received within said cylinder, a shaft means for driving said rotor, a number of vanes radially shiftably disposed within said rotor and adapted to be rotated relative to said cylinder as said rotor rotates so as to have their radially outward ends abut against the inner periphery of said cylinder, whereby fluid is sucked through said suction port and discharged through said discharge port under a pressure, and a bracket to close said cylinder at its open end, wherein the improvement comprises:

an auxiliary radially shifting mechanism for said vanes having a ring-shaped projection, provided on said bracket so as to protrude therefrom into direct radial contact with the vanes over the entire width of the protrusion and to be concentric with said cylinder but to be eccentric with said shaft means, the outer radial peripheral edge of said ring-shaped projection being rounded so that the mechanical strength of the vanes remains superior even if the pump is operating for a long time.

* * * * *